US007123197B2

(12) United States Patent
Suzuki

(10) Patent No.: US 7,123,197 B2
(45) Date of Patent: Oct. 17, 2006

(54) MINIATURIZED ANTENNA-COUPLED MODULE

(75) Inventor: Tomotaka Suzuki, Fukushima (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/999,629

(22) Filed: Nov. 30, 2004

(65) Prior Publication Data

US 2005/0122268 A1 Jun. 9, 2005

(30) Foreign Application Priority Data

Dec. 5, 2003 (JP) ..... 2003-407275

(51) Int. Cl.
*H01Q 1/24* (2006.01)

(52) U.S. Cl. ..... 343/702; 343/700 MS; 343/848

(58) Field of Classification Search ..... 343/700 MS, 343/702

See application file for complete search history.

(56) References Cited

U.S. PATENT DOCUMENTS

| | | | | |
|---|---|---|---|---|
| 5,550,554 | A | 8/1996 | Erkocevic | |
| 6,255,994 | B1 * | 7/2001 | Saito | 343/700 MS |
| 6,456,249 | B1 * | 9/2002 | Johnson et al. | 343/702 |
| 6,539,207 | B1 | 3/2003 | del Castillo et al. | |
| 6,630,911 | B1 * | 10/2003 | Kamei et al. | 343/873 |
| 2002/0070902 | A1 * | 6/2002 | Johnson et al. | 343/702 |
| 2003/0103009 | A1 * | 6/2003 | Schmidt et al. | 343/702 |
| 2004/0263399 | A1 * | 12/2004 | Lin et al. | 343/702 |

FOREIGN PATENT DOCUMENTS

| | | |
|---|---|---|
| EP | 0 621 653 | 10/1994 |
| JP | 2002-232221 | 8/2002 |
| JP | 2003188620 | 7/2003 |
| JP | 3102195 | 3/2004 |

* cited by examiner

*Primary Examiner*—Don Wong
*Assistant Examiner*—Binh Van Ho
(74) *Attorney, Agent, or Firm*—Brinks Hofer Gilson & Lione

(57) ABSTRACT

A circuit component group of a high frequency circuit is mounted on an upper surface of a circuit board. The circuit board contains a multilayered dielectric board having a ground conductor therein. An antenna element 6 made of a metal plate is mounted so as to cover a portion of the circuit component group. The antenna element contains a radiating conductive plate arranged opposite to and parallel to the circuit board, a feeding terminal piece bent from a peripheral portion of the radiating conductive plate, a ground terminal piece, and three leg pieces. The feeding terminal piece is connected to a feeding line of a wiring pattern, the ground terminal piece is connected to the ground conductor, and the leg pieces are soldered to the connecting lands formed on an upper surface of the circuit board, respectively.

4 Claims, 2 Drawing Sheets

MINIATURIZED ANTENNA-COUPLED MODULE

This application claims the benefit of priority to Japanese Patent Application No. 2003-407275 filed on Dec. 5, 2003, herein incorporated by reference.

BACKGROUND OF THE INVENTION

1. Field of the Invention

The present invention relates to an antenna-coupled module which is suitable to be used as a small transmission and reception unit for communication or broadcasting.

2. Description of the Related Art

Recently, accompanying with developments of wireless communication technologies, various electronic equipments or wireless cards into each of which a small transmission and reception unit is incorporated are suggested. As the transmission and reception unit, conventionally, an antenna-coupled high frequency module having an antenna element provided on a circuit board on which a high frequency circuit is provided is known. In the conventional antenna-coupled module, it is common that a predetermined area on the circuit board on which main parts of the high frequency circuit are provided is covered with a shield case made of a metal plate and the antenna element such as a chip antenna or a pattern antenna is provided at another area on the circuit board.

In such a conventional antenna-coupled module, the high frequency circuit comprises a wiring pattern formed on an upper surface of the circuit board, various circuit components, such as chip components or ICs, connected to the wiring pattern, and a ground conductor formed on a bottom surface or an inner layer of the circuit board, in which a portion of the wiring pattern extends outside the shield case to be connected to a feeding portion of the antenna element. Further, the ground conductor is connected to a ground portion of the antenna element through a via hole formed in the circuit board. Simultaneously, the ground conductor is also connected to the shield case. The shield case is mounted to the circuit board while covering the main parts of the high frequency circuit, such that the high frequency circuit is almost electromagnetically shielded (for example, see Japanese Unexamined Patent Application Publication No. 2002-232221 (FIG. 1, p. 4–6)).

As described above, in the conventional antenna-coupled module, the antenna element and the shield case are provided on the circuit board in parallel and the shield case covers the main parts of the high frequency circuit. Thus, even if the shield case and the antenna element are arranged as nearly as possible, the size of the module increases somewhat as a whole in a plan view, which results in a problem in that it is difficult to achieve miniaturization. Further, in the conventional antenna-coupled module, since the space for the antenna element is narrow, there may be many cases in which an additional antenna element such as a chip antenna is needed to be mounted on the circuit board so as to a desired electric field in a radiating conductive portion.

Therefore, there is a problem in that the number of the components increases, which consequently increases the manufacturing cost of the module.

SUMMARY OF THE INVENTION

The present invention has been made in consideration of the above-mentioned problems, and it is an object of the present invention to provide an antenna-coupled module of which the miniaturization can be accomplished and the manufacturing cost can be reduced.

In order to achieve the above-mentioned object, an antenna-coupled module according to the present invention comprises a dielectric board provided on a ground conductor, connecting lands provided on the dielectric board, a circuit component group of a high frequency circuit mounted on the dielectric board, and a radiating conductive plate made of a metal plate covering at least a portion of the circuit component group. Further, a feeding terminal piece, a ground terminal piece, and leg pieces are bent from the radiating conductive plate, the feeding terminal piece is connected to the feeding line of the high frequency circuit, the ground terminal piece is connected to the ground conductor, and the leg pieces are soldered to the connecting lands respectively to support the radiating conductive plate.

In the antenna-coupled module having the above-mentioned configuration, the radiating conductive plate, made of the metal plate, which is grounded while covering at least the portion of the high frequency circuit plate operates as an inverted F type antenna. Thus, the antenna element and the shield case are not needed to be provided on the circuit board in parallel. In addition, the connecting lands on which the leg pieces bent from the radiating conductive plate are mounted and soldered face the ground conductor through the dielectric board, and thus an additional capacitance is formed between the connecting lands and the ground conductor. Accordingly, since the resonance frequency decreases, the radiating conductive plate can be miniaturized. Specifically, in the antenna-coupled module of the present invention, the inverted F type antenna functions as the shield case and also the miniaturization of the reverse F-type antenna itself can be accomplished. Therefore, the entire module can be drastically miniaturized. Further, the number of the components can be reduced and thus the manufacturing cost can be reduced.

In the above-mentioned configuration, preferably, the leg pieces are bent from a plurality of locations of the radiating conductive plate and are soldered to the connecting lands provided on the dielectric board, respectively. Thus, the radiating conductive plate can be stably supported on the dielectric board. Further, the resonance frequency varies according to the size or the arrangement of each of the plurality of connecting lands, the fine adjustment of the resonance frequency can be easily accomplished.

Further, in the above-mentioned configuration, preferably, the feeding terminal piece and the ground terminal piece are arranged adjacent to each other at one end of the dielectric board in a longitudinal direction and a connector is arranged at the other end of the dielectric board in the same longitudinal direction. Thus, upon the operation of the inverted F type antenna, the current flows between the one end of the dielectric board and the connector, and the antenna element becomes a non-directional radiating antenna, similar to a monopole antenna or a dipole antenna. Therefore, an antenna-coupled module can be realized as a transmission and reception unit which can be used in a state the connector is inserted into an electronic apparatus main body such as a personal computer.

Further, in the above-mentioned configuration, the ground conductor may be formed in an inner layer of the multilayered dielectric board and another circuit component group may be mounted on a bottom surface of the multilayered dielectric board. If so, the occupying area of the circuit board can be more efficiently used.

According to the antenna-coupled module of the present invention, the radiating conductive plate, made of the metal plate, which is grounded while covering at least the portion of the high frequency circuit operates as the reverse F-type antenna, such that the antenna element functions as the shield case. Besides, the additional capacitances between the connecting lands soldered to the leg pieces of the inverted F type antenna and the ground conductor are formed, such that the resonance frequency decreases. Thus, the miniaturization of the inverted F type antenna itself can be realized, such that the entire module can be drastically miniaturized. Further, the number of the components can be reduced and thus the manufacturing cost can be reduced.

DESCRIPTION OF THE PREFERRED EMBODIMENT

Figure 1:
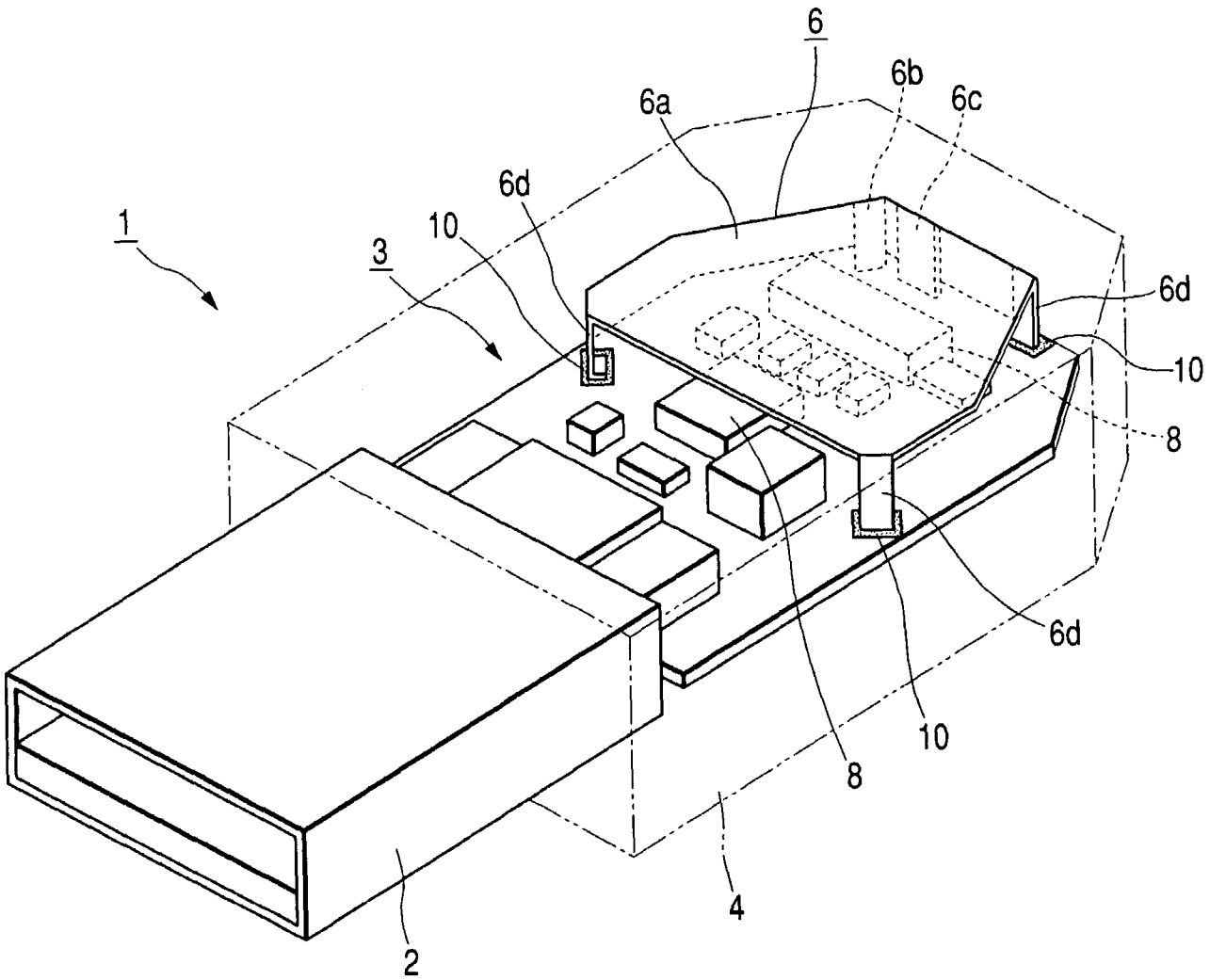
FIG. 1 is a perspective view of a wireless card according to an embodiment of the present invention.

Hereinafter, an embodiment of the present invention will be described with reference to the drawings. FIG. 1 is a perspective view of a wireless card according to an embodiment of the present invention, FIG. 2 is a plan view of an antenna-coupled module which is incorporated into the wireless card, and FIG. 3 is a cross-sectional view of the antenna-coupled module.

The wireless card 1 shown in FIG. 1 is a transmission and reception unit which is inserted into an insertion slot of a main body of an electronic apparatus (not shown), such as a personal computer, and transmits or receives wireless data between the electronic apparatus main body and peripheral apparatuses. The wireless card 1 comprises a connector 2 such as USB connector, an antenna-coupled module 3 which is described below, and a case 4, made of synthetic resin, for housing the antenna-coupled module 3.

Figure 2:
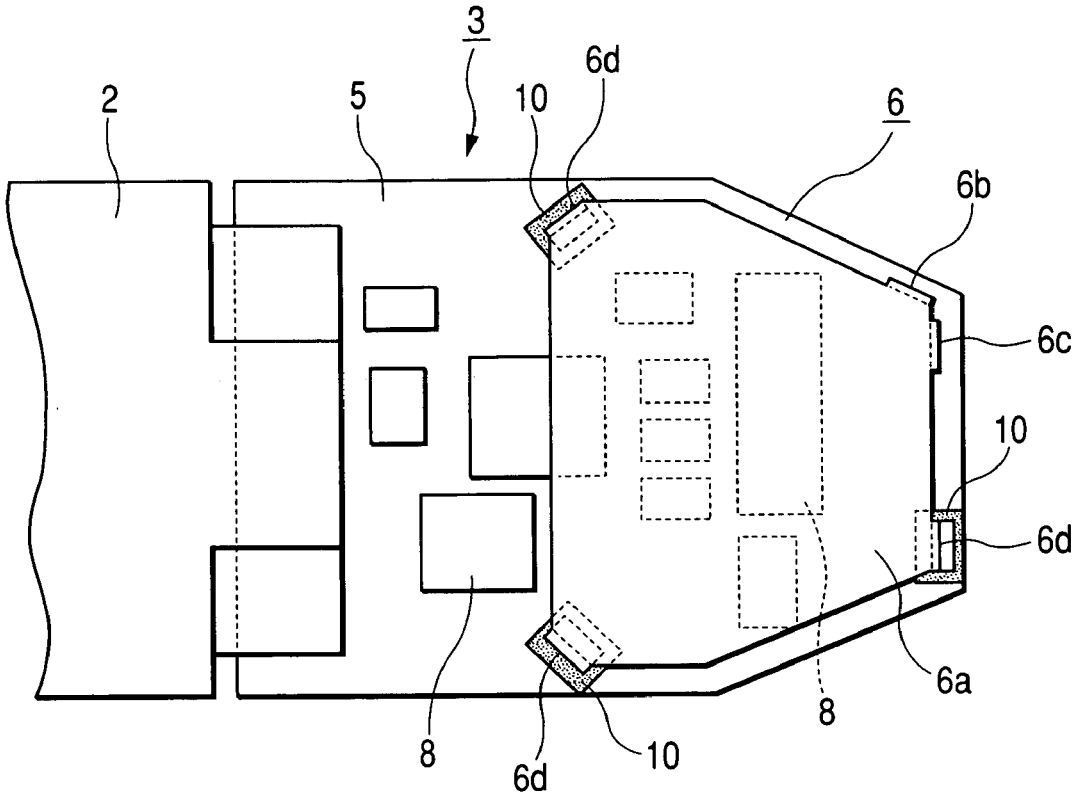
FIG. 2 is a plan view of an antenna-coupled module which is incorporated into the wireless card.
Figure 3:
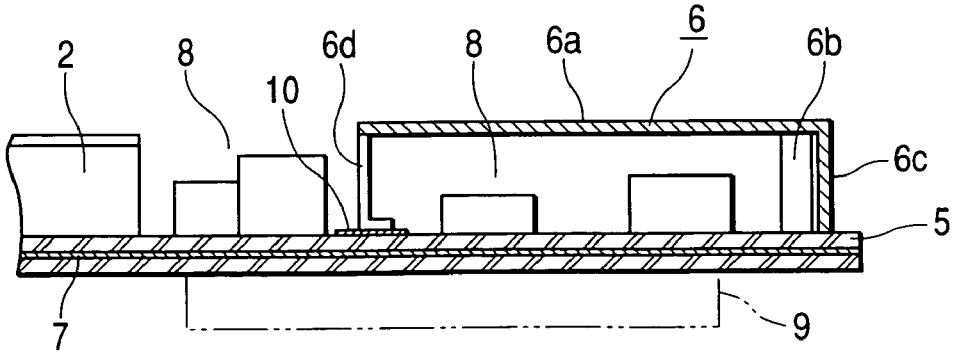
FIG. 3 is a cross-sectional view of the antenna-coupled module.

As shown in FIGS. 2 and 3, the antenna-coupled module 3 mainly comprises a circuit board 5 on which a high frequency circuit is arranged, and an antenna element 6, made of a metal plate, which is mounted on the circuit board 5. The circuit board 5 is made of a multilayered dielectric board having a ground conductor 7 therein. The rectangular circuit board 5 is formed in a shape in which two corners of one end thereof in a longitudinal direction are cut, and the antenna element 6 is mounted so as to cover approximately the half surface of the one end of the circuit board 5. The connector 2 is mounted to the other end of the circuit board 5 in the longitudinal direction. The high frequency circuit of the module comprises wiring patterns (not shown) formed on an upper surface and a bottom surface of the circuit board 5, circuit component groups 8 and 9, such as chip components or ICs, which are connected to the wiring patterns, and the ground conductor 7 in an inner layer of the circuit board 5. On the upper surface of the circuit board 5, three connecting lands 10 electrically isolated from the wiring pattern are formed.

The antenna element 6 comprises a radiating conductive plate 6*a* provided opposite to and parallel to the circuit board 5, a feeding terminal piece 6*b* bent in an approximately right angle with respect to the radiating conductive plate 6*a*, a ground terminal piece 6*c*, and three leg pieces 6*d*. A portion of the circuit component group 8 mounted on the upper surface of the circuit board 5 is covered with the radiating conductive plate 6*a*. The radiating conductive plate 6*a* is formed in a pentagonal shape so as to be fit to the shape of the circuit board 5. Further, the feeding terminal piece 6*b* and the ground terminal piece 6*c* are formed adjacent to a corner at which two adjacent sides of the radiating conductive plate 6*a* intersects, and the leg pieces 6*d* are formed so as to be dispersed at other corners of the radiating conductive plate 6*a*. And then, a lower end of the feeding terminal piece 6*b* is connected to the feeding line of the wiring pattern (not shown), and a lower end of the ground terminal piece 6*c* is connected to the ground conductor 7 through a via hole (not shown) or the like. The lower ends of the leg pieces 6*d* are respectively soldered to the corresponding connecting lands 10. Specifically, the antenna element 6 has the same configuration as that of the inverted F type antenna made of the metal plate and is connected to the ground conductor 7 through the metal plate. Thus, the antenna element 6 can be considered as the shield case which covers main parts of the high frequency circuit.

Further, according to the antenna-coupled module having the above-mentioned configuration, the antenna element 6, made of the metal plate, which is grounded while covering at least a portion of the high frequency circuit operates as the inverted F type antenna. Simultaneously, the antenna element 6 serves as the shield case for electromagnetically shielding the high frequency circuit. Thus, the antenna element and the shield case are not needed to be provided on the circuit board 5 in parallel. Besides, the leg pieces 6*d* bent from the radiating conductive plate 6*a* of the antenna element 6 are respectively mounted on and soldered to the connecting lands 10. In this case, the connecting lands 10 face the ground conductor 7 through the dielectric board of the circuit board 5 respectively, such that the additional capacitances are formed between the respective connecting lands 10 and the ground conductor. Therefore, the resonance frequency of the antenna element 6 is lowered as compared to the case that there is no the additional capacitance, thereby reducing the size of the radiating conductive plate 6*a* required for a resonance with a specific frequency. That is, the antenna element 6 which operates as the inverted F type antenna also serves as the shield case. Thus, the miniaturization of the antenna element 6 itself is realized, thereby drastically miniaturizing the entire module. Further, the number of the components can be reduced and thus the manufacturing cost can be reduced.

Also, according to the antenna element 6, the leg pieces 6*d* are mounted on and soldered to the connecting lands 10 respectively, and thus the radiating conductive plate 6*a* can be stably supported on the circuit board 5. Further, the additional capacitance which varies according to the size or the arrangement of each of the connecting lands 10 can be suitably adjusted, thereby varying the resonance frequency. As a result, the wide band or the fine adjustment of the resonance frequency can be easily realized.

Further, the feeding terminal piece 6*b* and the ground terminal piece 6*c* of the antenna element 6 mounted on the circuit board 5 are arranged adjacent to each other at the one end of the circuit board 5 in the longitudinal direction. The connector 2 is arranged at the other end of the circuit board 5 in the longitudinal direction. Thus, upon the operation of the antenna element 6, the current flows between the connector 2 and the one end of the circuit board 5. Therefore, the antenna element 6 operates as a non-directional radiating antenna, similar to a monopole antenna or a dipole antenna. For this reason, if the antenna-coupled module 3 is applied to the wireless card 1 in which transmission and reception can be performed by a built-in antenna, the miniaturized wireless card 1 can be realized at low cost.

Further, the multilayered dielectric board in which the ground conductor 7 is formed is used as the circuit board 5 and another circuit component group 9 is mounted on a bottom surface of the dielectric multilayered board. Thus, the limited occupying area of the circuit board 5 can be more efficiently used.

Moreover, in the above-mentioned embodiment, the radiating conductive plate 6*a* of the antenna element 6 is formed in a pentagon shape and three leg pieces 6*d* are bent from an outer peripheral portion of the radiating conductive plate 6*a*. However, the shape of the radiating conductive plate 6*a* or the number of the leg pieces 6*d* is not limited to the above-mentioned embodiment. For example, the radiating conductive plate 6*a* may be formed in a rectangular shape or a circular shape. Further, two leg pieces 6*d* or four leg pieces 6*d* or more may be formed. Further, a slit having a linear shape or a meander shape may be formed in the radiating conductive plate 6*a*. In this case, the path length of the high frequency current flowing in the radiating conductive plate 6*a* becomes long and thus the resonance frequency decreases. As a result, the antenna element 6 can be more miniaturized.

Further, in the above-mentioned embodiment, the portion of the circuit component group 8 mounted on the circuit board 5 is covered with the radiating conductive plate 6*a* in the above-mentioned embodiment. However, the entire circuit component group 8 may be covered with the radiating conductive plate 6*a*. In addition, a single-layered dielectric board may be used as the circuit board 5 and the ground conductor 7 may be formed on the bottom surface of the dielectric board. In this case, the circuit component group 9 mounted on the bottom surface of the circuit board 5 may be omitted.

What is claimed is:

1. An antenna-coupled module comprising:

a dielectric board provided on a ground conductor;

connecting lands provided on the dielectric board;

a circuit component group of a high frequency circuit mounted on the dielectric board; and a radiating conductive plate, made of a metal plate, which covers at least a portion of the circuit component group, wherein a feeding terminal piece, a ground terminal piece, and leg pieces are bent from the radiating conductive plate, the feeding terminal piece is connected to the feeding line of the high frequency circuit, the ground terminal piece is connected to the ground conductor, and each of the leg pieces are soldered to each of the connecting lands to support the radiating conductive plate; and wherein the radiating conductive plate shields the circuit component group of the high frequency circuit.

2. The antenna-coupled module according to claim 1, wherein the leg pieces are bent from a plurality of locations of the radiating conductive plate, and the radiating conductive plate is supported on the dielectric board by the leg pieces.

3. The antenna-coupled module according to claim 1, wherein the feeding terminal piece and the ground terminal piece are arranged adjacent to each other at one end of the dielectric board in a longitudinal direction and a connector is arranged at the other end of the dielectric board in the longitudinal direction.

4. The antenna-coupled module according to claim 1, wherein the dielectric board is a multilayered board having the ground conductor therein, and another circuit component group is mounted on a bottom surface of the multilayered board.

* * * * *